United States Patent [19]

Bick et al.

[11] Patent Number: 4,563,766

[45] Date of Patent: Jan. 7, 1986

[54] ELECTRIC ARC FURNACE FOR MELTING METAL, ESPECIALLY STEEL

[75] Inventors: Klaus Bick, Paderborn; Lothar Harmsen, Lingen; Wilhelm Lachenmayer, Detmold; Jürgen Zieschang, Lingen, all of Fed. Rep. of Germany

[73] Assignee: Benteler-Werke AG, Paderborn, Fed. Rep. of Germany

[21] Appl. No.: 82,753

[22] Filed: Oct. 9, 1979

[30] Foreign Application Priority Data

Oct. 7, 1978 [DE] Fed. Rep. of Germany ..... 2843881

[51] Int. Cl.[4] ..... F27D 1/00; F27B 3/00

[52] U.S. Cl. ..... 373/72; 373/73; 373/76

[58] Field of Search ..... 13/35, 32; 373/72, 73, 373/76

[56] References Cited

U.S. PATENT DOCUMENTS 4,259,539 3/1981 Elsner et al. ..... 13/32

*Primary Examiner*—A. D. Pellinen
*Assistant Examiner*—Gregory D. Thompson
*Attorney, Agent, or Firm*—Michael J. Striker

[57] ABSTRACT

An electric arc furnace for melting metal, especially steel, includes a container having an upper open ended substantially cylindrical wall portion and a lower cylindrical wall portion extending downwardly therefrom and being closed at the bottom and receiving during operation of the furnace a bath of molten material having an upper level at a predetermined maximum elevation above the bottom of the container. The container includes an outer metal shell and refractory material covering at least the lower wall portion of the shell and the closed bottom. In order to increase the charging volume of the container without essentially changing the height thereof, the upper wall portion has, at a distance of at least 300 mm above the level the bath of molten metal, an inner diameter which is greater than the outer diameter of the metal shell of the lower wall portion.

9 Claims, 4 Drawing Figures

ELECTRIC ARC FURNACE FOR MELTING METAL, ESPECIALLY STEEL

BACKGROUND OF THE INVENTION

The present invention relates to an electric arc furnace for melting metal, especially steel, which includes a container having an upper open end adapted to be closed by a cover, and which at least in the region of its lower hearth portion and in the lower wall portion, extending upwardly from the hearth portion beyond the highest level of a mass of molten material forming therein, an outer metal shell covered at the inner surface with refractory material and having substantially the form of a hollow cylinder and defining at least in the upper wall portion an essentially circular cylindrical inner furnace space for the reception of the material to be melted.

In an electric arc furnace of this kind the heat produced by the arc between a plurality of electrodes is used for melting of metal, which for instance in the form of scrap metal is filled by means of a charging basket into the interior of the furnace.

The hearth lined with refractory material receives the liquid steel forming during the melting of the scrap. The dimension of the hearth depends on the amount of liquid steel provided for one melt. Above the cylindrical portion of the hearth there is located a cylindrical wall portion to serve for the reception of a maximum amount of scrap. The furnace container usually has the same diameter in the cylindrical part of the hearth and in the upper cylindrical wall portion. The height of the container wall is determined by the weight of the scrap to be melted and the number of charges for one melt.

In the usual operating practice of electric arc furnaces, the furnace is filled by means of a charging basket several times with scrap. After the first charge, which fills the total volume of the furnace container, is molten therein, the furnace container is again charged and after melting of the second charge the third charging is carried out, and so on.

The number of charges depends on the bulk weight and the furnace volume. Each charging process results, in electric arc furnaces, in an interruption of the production and a high heat loss since the furnace cover with the electrode must be tilted away from the upper open end of the furnace container during the charging of the scrap thereinto.

The charging of the furnace for a melting operation in a plurality of successive filling operations is preferred over the charging with only one filling operation, especially for the reason that otherwise the furnace container for the reception of one and the same total charge would require considerably greater outer dimensions. Such a furnace container for a single charge for each melting operation would have the disadvantage of considerably higher capital outlays, which necessarily would disadvantageously influence the cost of the melting operation. The height of the furnace container is normally so dimensioned that for a single melt two to five filling operations are necessary depending on the quality of the scrap material to be fed into the furnace.

The refractory stones and refractory material which protect the walls of the furnace container are attacked by the electric arcs, as well as by the liquid steel and the slag. Therefore, the charging volume of the furnace container gradually increases during use thereof, due to the erosion of the refractory meterial. Therefore, after a predetermined time of use of the furnace the latter has to be newly lined, while at the end of this predetermined time at which the furnace container has to be newly lined, at least an additional charge has to be filled in the container to provide in the latter a bath of molten metal with the predetermined upper level.

In order to reduce the charging and leveling time during the first half of the useful life of the lining of the furnace container as compared to the second half of the useful life thereof, the lining of the furnace container in the upper region thereof was provided with shorter special refractory stones, the useful life thereof was at least equal to the normal longer stones.

A second step to enlarge the inner space of the furnace container was the use of water cooled wall elements. The up to now used lining of refractory stones over the whole height of the furnace container has thereby been replaced in the upper wall region, above the highest level of the molten metal bath forming therein, by water cooled wall elements which have been constructed especially small.

SUMMARY OF THE INVENTION

It is an object of the present invention to provide a furnace container for an electric arc furnace for melting metal, especially steel, which is provided with a larger charging volume, without essentially changing the usually provided height of the furnace container and the dimensions of the hearth thereof.

With these and other objects in view, which will become apparent as the description proceeds, the container for an electric arc furnace for melting metal, especially steel has an upper open ended substantially cylindrical wall portion in which the metal to be melted is fed and a lower substantially cylindrical wall portion extending downwardly therefrom and being closed by a hearth at the bottom to receive during operation of the furnace a bath of molten metal having a predetermined maximum upper level, in which the container includes an outer cylindrical metal shell and refractory material covering the inner surface of at least the lower wall portion and the closed bottom thereof and wherein the upper wall portion has at a distance of at least 300 mm upwardly from the predetermined maximum level of the bath of molten metal an inner diameter which is greater than the outer diameter of the shell of the lower cylindrical wall portion.

By use of the invention the charging volume of the electric arc furnace may, for instance, be more than 30% greater than that of known freshly lined arc furnaces of this kind. This increase of the charging volume means will produce, in comparison with known arc furnaces of this kind, an essential increase of the useful life of the arc furnace and at the same time a considerable saving of energy, due to the reduced heat losses during removal of the furnace cover during the charging. This increase of the charging volume increases very considerably the production of the electric arc furnace. Already during the first half of the useful life of the furnace, in which the charging volume thereof is not increased due to the wear of the refractory lining thereof, it is possible to operate with one charging operation less for each melt.

The enlargement of the furnace container in the upper wall region according to the invention has the further advantage that less time for planing of the scrap is needed and that during the charging dropping of pieces of scrap on the upper closure ring of the furnace container are avoided. In order to remove dust from the furnace container in an optimal manner, no scrap should rest between the upper closure ring of the furnace container and the furnace cover, since otherwise there would exist a gap between the two rings through which air would be drawn into the furnace. In order to prevent formation of such a gap, the operator has to remove any scrap accumulating on the upper closure ring of the furnace, which operation is difficult, disagreeable and requires considerable time. Due to the increase of the diameter in the upper wall region of the furnace container the likelihood of accumulation of scrap on the upper closure ring of the furnace during the charging operation is considerably reduced, from which results a considerable simplification of the work of the operator and a reduction of the charging time.

The obtainable increase of the charging volume according to the present invention is limited by the fact that, at a too large difference between the inner diameter in the upper wall region of the furnace container and the outer diameter of the sheet metal shell in the lower wall region thereof, the danger exists that the scrap may not properly slide down during the melting operatron, but may at least in part rest on the shoulder forming between the radially enlarged upper wall portion and the reduced lower wall portion, which would lead to an increase of the melting time of the scrap. In addition, at a too large diameter in the upper region of the furnace container, the scrap adjacent to the wall of the container would not be completely melted by the electric arc. It is therefore preferred that the inner diameter of the furnace container in the upper wall region thereof at a distance of at least 300 mm above the highest level of the molten metal bath forming therein is 100 to 600 mm, preferably 200 to 400 mm, greater than the outer diameter of the sheet metal shell at the lower wall portion of the container.

How far the inner diameter of the upper cylindrical wall portion of the furnace container can be increased depends, especially at existing arc furnaces, from the construction thereof. Advantageously, water-cooled wall elements are used in the upper wall region instead of the refractory lining. By appropriate small dimensioning of the water cooled wall elements it is also possible, in existing electric arc furnaces, to obtain a considerable increase of the charging volume by the outward displacement of the upper wall region. The gap between the lower region of these wall elements and the upper edge of the outer metal shell is sealed by appropriate means, such as refractory stones or other refractory material. This is necessary to prevent dropping of pieces of scrap during the charging through the gap and to prevent during the melting process escape of liquid steel through the gap. The seal will also prevent drawing of air into the furnace.

Especially in the case of an electric arc furnace with a large interior space, it is advantageous to place into the aforementioned gap a water cooled, properly sealed ring, which will not only seal the annular gap, but also protect the furnace wall from thermal wear. This sealing ring is a hollow profile ring, concentric to the axis of the arc furnace, flown through by cooling water, and covered at the upper side with refractory material. Especially in electric arc furnaces with a large charging volume it is recommended that the annular region between the upper edge of the outer metal shell and the lower region of the water cooled wall elements is sufficiently covered with refractory material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the various Figures of the drawing only one half of the container of an electric arm furnace of cylindrical cross section is illustrated, whereby the furnace cover including the electrodes, which is to be mounted on the upper open end of the furnace container, is not shown in the various Figures and the furnace lining is shown partly worn due to thermal and mechanical wear.

FIG. 4 illustrates a third embodiment of a furnace container according to the present invention provided with a sealing ring between the outer cylindrical metal shell of the lower wall portion and the water-cooled wall elements of the upper wall portion.

DESCRIPTION OF THE PREFERRED EMBODIMENTS

Figure 1:
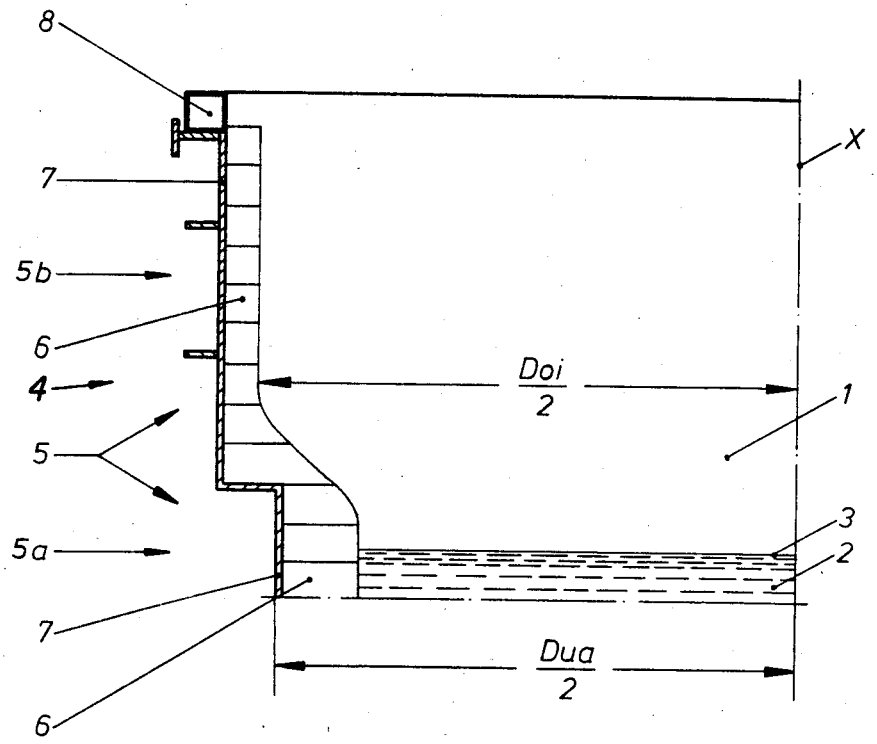
FIG. 1 illustrates a furnace container of an electric arc furnace according to the prior art.

Referring first to FIG. 1, which illustrates a furnace container for an electric arc furnace according to the prior art, it will be seen that this container includes a trough-shaped hearth 4 and a furnace wall 5 upwardly extending therefrom with a lower wall region 5*a* and an upper wall region 5*b*. The lower portion of the interior 1 of the furnace container is filled with a bath of molten metal 2 up to a predetermined maximum level 3. The furnace container shown in FIG. 1 includes an outer shell 7 of sheet steel and the inner surface thereof is lined with refractory stones 6. The interior 1 of the container is at least in the upper wall region 5*b* of circular cylindrical cross section.

A closure ring 8 is connected to the upper edge of the wall 5, onto which the nonillustrated cover for closing the upper end of the container may be placed. The furnace is electrically heated in the region of the cover by three electrodes introduceable through the cover into the interior of the furnace. As mentioned before, the cover and the electrodes of well known construction are not illustrated in the drawing.

In the furnace container according to the prior art illustrated in FIG. 1, the outer sheet metal shell 7 is lined over the whole height of the furnace container with refractory stones. In this construction according to the prior art the outer sheet metal shell 7 has in the lower wall region 5*a*, as well as in the upper wall region 5*b*, the same diameter. Only the thickness of the refractory lining in the upper wall region 5*b* is smaller than in the lower wall region 5*a*.

In the electric arc furnace according to the prior art as illustrated in FIG. 1 the inner diameter $D_{oi}$ of the furnace container is therefore over the whole height of the container smaller than the outer diameter $D_{ua}$ of the outer metal shell 7.

Figure 2:
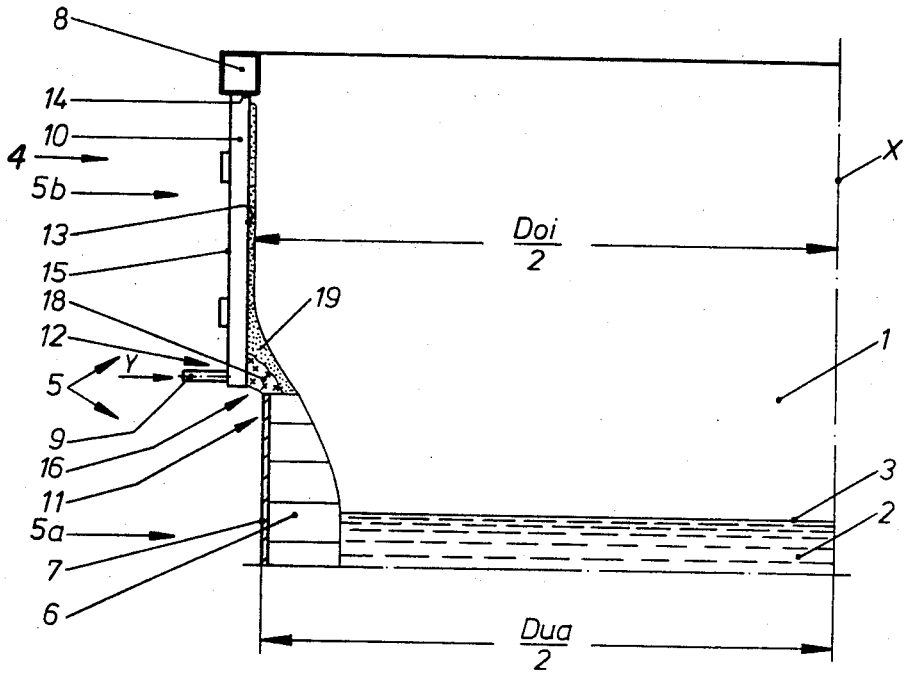
FIG. 2 illustrates a first embodiment of a furnace container according to the present invention with a radially enlarged upper wall portion.
Figure 3:
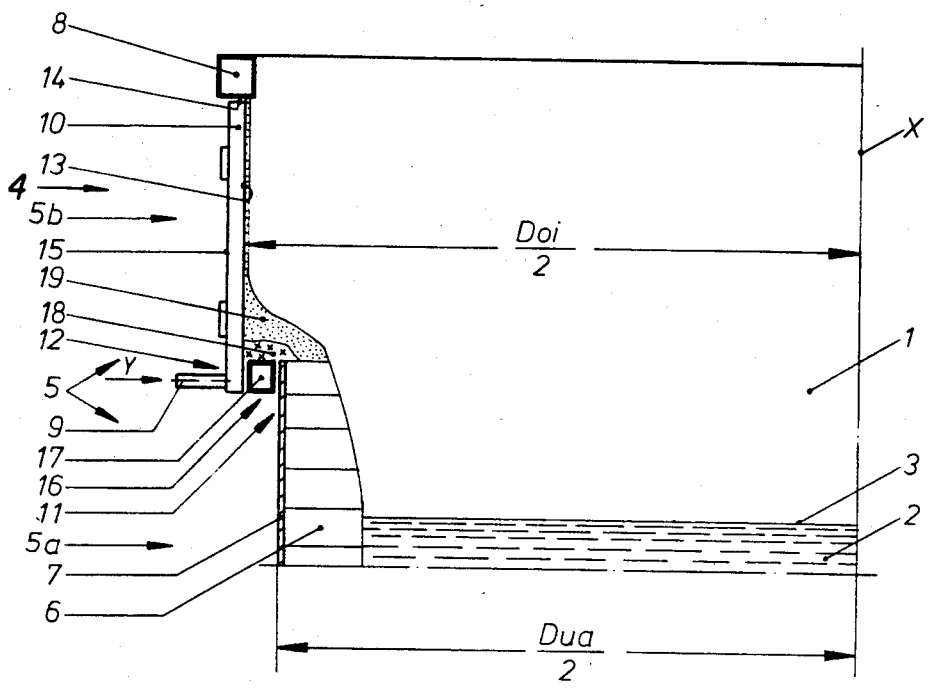
FIG. 3 illustrates a second embodiment according to the present invention in which the upper enlarged wall portion is formed by water-cooled wall elements.

FIGS. 2–4 respectively illustrate three embodiments according to the present invention in which the reference numeral 1 again indicates the interior of the furnace container, the reference numeral 2 the molten bath of metal forming during operation of the furnace in the lower part of the container with a predetermined maximum upper level indicated with the reference numeral 3. The outer furnace wall is again indicated with the reference numeral 5, whereby the reference numeral 5*a* designates the lower wall portion and 5*b* the upper wall portion of the container and the reference numeral 7 designates the outer metallic shell, which carries at the upper end the closure ring 8, onto which the nonillustrated cover is to be placed. For simplification reason the hearth portion 4, which is to be of the same shape and dimensions as shown in FIG. 1, is omitted in the FIGS. 2–4.

As can be seen from FIGS. 2–4 which illustrate three embodiments according to the prior art the inner diameter $D_{oi}$ of the container in the upper wall region 5*b*, above the highest level 3 of the bath of molten material, is larger than the outer diameter $D_{ua}$ of the outer metal shell 7 in the region of the lower wall portion 5*a*.

As shown in FIG. 2, which illustrates a first embodiment according to the present invention, the outer metal shell 7 extends over the total height of the furnace container and this outer metal shell is covered at the inner surface thereof over the total height of the container with refractory stones 6. In this embodiment the outer metal shell 7 in the upper wall region 5*b*, at a distance of at least 300 mm above the highest level 3 of the molten material, is radially outwardly offset with respect to the portion of the outer metal shell in the lower wall region 5*a*.

In the embodiments shown in FIGS. 3 and 4 the wall of the container is formed in the upper wall region 5*b* thereof by water-cooled wall elements 10 which are supplied with cooling water through a socket 9, as indicated by the arrow Y. The water-cooled wall elements 10 are provided about the whole circumference of the furnace container at a distance of at least 300 mm above the highest level 3 of the moten bath 2 forming at the bottom of the container.

In the embodiment illustrated in FIGS. 3 and 4 the outer metal shell 7 of the furnace container extends only in the region of the hearth 4, as well as over the lower wall portion 5*a* extending upwardly from the hearth portion beyond the highest level 3 of the molten metal forming at the lower part of the container, and the upper edge 11 of the metal shell 7 reaches up to the lower region 12 of the water-cooled wall elements 10. Each of the water-cooled wall elements 10 has a front wall 13 facing the interior 1 of the furnace container and being curved according to the curvature of the latter. The front wall is provided with a protective layer of refractory material.

The wall elements 10 are closed at the upper end by a wall portion 14, which abuts against the closure ring 8. The wall elements 10 are held together by connecting elements extending over the rear walls 15 of the wall elements, which are parallel to the front walls 13.

In the embodiments shown in FIGS. 3 and 4 the front walls 13 of the water-cooled elements 10, which face the interior 1 of the furnace container are radially outwardly offset with respect to the outer metal shell 7 in the lower wall region 5*a*, which extends above the highest level 3 of the molten metal bath gathering at the bottom of the furnace container. The annular transition region 16 between the upper edge 11 of the outer metal shell 7 and the lower region 12 of the wall elements 10 is closed towards the outside by refractory material 18.

In the embodiment shown in FIG. 4, in which the inner diameter $D_{oi}$ of the interior 1 of the furnace container in the upper wall region 5*b* thereof is considerably increased, as compared with the corresponding inner diameter $D_{oi}$ of the embodiment shown in FIG. 3, a water-cooled hollow ring 17 is provided in the annular transition region 16. This water-cooled hollow ring 17, which is arranged in the annular transition region 16 between the upper edge 11 of the outer metal shell 7 and the lower region 12 of the wall elements 10 concentric to the axis X of the furnace container, is at least in the upper region and toward the interior of the furnace container covered with a mass of refractory material 18.

In the embodiments shown in FIGS. 3 and 4 a thin layer of refractory material is applied before the first melting process onto the front wall 13 of the water-cooled wall elements 10 and this layer is extended up to the refractory stones covering the inner surface of the outer metal shell 7 in such a manner to provide a substantially stepless transition between the inner surface at the upper wall portion 5*a* and that of the lower wall portion 5*b*.

In the embodiment shown in FIG. 2 the height of the upper wall portion 5*b* is about half of the total height of the furnace container, and in the embodiments shown in FIGS. 3 and 4, in which the inner diameter at the upper wall portion 5*b* is further increased as compared to that of the embodiment shown in FIG. 2, the height of the upper wall portion 5*b* is about two fifth's of the total height of the container.

It will be understood that each of the elements described above, or two or more together, may also find a useful application in other types of electric arc furnaces differing from the types described above.

While the invention has been illustrated and described as embodied in a container for an electric arc furnace to be filled with scrap material to be molten therein, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electric arc furance for melting metal, especially steel, a container having an upper open ended substantially cylindrical wall portion into which the metal to be melted is fed and a lower substantially cylindrical wall portion extending downwardly from said upper wall portion and being closed at the bottom to receive during operation of the furnace a bath of molten metal having an upper level at a predetermined maximum elevation above the closed bottom of the container, said container including an outer cylindrical metal shell and refractory material covering the inner surface of said upper wall portion, said lower wall portion and the closed bottom thereof, said upper wall portion having at a distance of at least 300 mm above said predetermined maximum elevation of the upper level of the molten metal bath an inner diameter which is at least 100 mm greater than the outer diameter of the shell at said lower wall portion.

2. A furnace container as defined in claim 1, wherein said inner diameter of said upper cylindrical wall portion is at least 200 mm greater than the outer diameter of said metal shell at said lower wall portion.

3. A furnace container as defined in claim 1, wherein said inner diameter of said upper cylindrical wall portion is 100 to 600 mm greater than the outer diameter of the metal shell at said lower wall portion.

4. A furnace container as defined in claim 1, wherein the inner diameter of said upper cylindrical wall portion is 200 to 400 mm greater than the outer diameter of said metal shell at said lower wall portion.

5. A furnace container as defined in claim 1, wherein said metal shell extends over the whole height of the container, wherein the inner surface of the shell is covered over the whole height of the container with refractory material, and wherein said cylindrical metal shell in the region of said lower wall portion is inwardly offset with respect to the metal shell in the region of said upper cylindrical wall portion.

6. A furnace container as defined in claim 1, wherein said upper cylindrical wall portion comprises water-cooled upright wall elements having wall portions facing the interior of said container and being radially outwardly offset with respect to the metal shell at the region of the lower wall portion.

7. A furnace container as defined in claim 6, wherein said outer cylindrical metal shell extends only through the region of the lower wall portion and the bottom thereof and having an upper edge located at the region of the lower ends of said upright water-cooled wall elements.

8. A furnace container as defined in claim 7, wherein an annular gap is formed between said upper edge of said outer metal shell and the lower ends of said water-cooled wall elements, and including refractory meterial for sealing said annular gap.

9. A furnace container as defined in claim 7, wherein said upper edge of said outer metal shell extends upwardly beyond and radially inwardly displaced from the lower ends of said water-cooled wall elements to form an annular gap with the latter, and including a water-cooled ring in said annular gap and refractory material above said ring and sealing any clearance between the latter, said metal shell and said water-cooled elements.

* * * * *